United States Patent [19]

Schaefer

[11] 4,003,392

[45] Jan. 18, 1977

[54] PROCESS AND APPARATUS FOR CLEANING MOS-LSI DIE

[75] Inventor: Robert L. Schaefer, Anaheim, Calif.

[73] Assignee: Rockwell International Corporation, El Segundo, Calif.

[22] Filed: Jan. 29, 1976

[21] Appl. No.: 653,571

[52] U.S. Cl. ..... 134/30; 134/25 R; 134/88; 134/95; 134/104; 134/151

[51] Int. Cl.[2] ..... B08B 30/00

[58] Field of Search ..... 134/25 R, 26, 30, 59, 134/85, 88, 94, 95, 104, 142, 145, 151

[56] References Cited

UNITED STATES PATENTS

| | | | |
|---|---|---|---|
| 701,129 | 5/1902 | Belknap | 134/88 |
| 2,916,407 | 12/1959 | Buck et al. | 134/30 |
| 3,066,050 | 11/1962 | Garton, Jr. | 134/30 |
| 3,405,720 | 10/1968 | Carlson | 134/142 X |
| 3,746,022 | 7/1973 | Fillion et al. | 134/145 X |

*Primary Examiner*—Arthur D. Kellogg
*Attorney, Agent, or Firm*—H. Fredrick Hamann; G. Donald Weber, Jr.; Roland G. Rubalcava

[57] ABSTRACT

A process and apparatus for cleaning particles from the surfaces of MOS-LSI die is disclosed. The present invention involves cleaning apparatus that includes a process tank, a manifold fixture that secures a plurality of universal inserts having variable die size cavities and a multi-nozzle agitator assembly that attaches to said manifold fixture having means for directing pressurized gas and fluid means. The die inserts are selected, fitted and secured in the cavities of the manifold fixture. The dice are installed and secured in the die inserts. The loaded manifold fixture is positioned over the process tank where the dice are rinsed with deionized water, rinsed with alcohol, inspected, scrubbed, pressure rinsed with deionized water, pressure rinsed with alcohol and dried with nitrogen, inspected and secured in clean die trays.

12 Claims, 4 Drawing Figures

PROCESS AND APPARATUS FOR CLEANING MOS-LSI DIE

BACKGROUND OF THE INVENTION

1. Field of the Invention

This invention relates to apparatus for processing MOS-LSI devices and more particularly to removing unwanted particles and contamination from the surfaces of dice or chips without damage thereto.

2. Description of the Prior Art

In the fabrication of MOS-LSI devices, foreign particles and contamination frequently contribute to the low yield of dice or chips which have been scribed and divided from device wafers. Most of the device dice or chips that survive scribing and separation have been coated with a protective film or layer such as silox for preventing physical changes or moisture from accumulating on the metallized conductors. Even the protective layer has an affinity for particulate and contamination. The coated dice or chips are evaluated for particulate at a die visual inspection with a microscope on the order of 100X power. At die visual inspection, there are two major modes that account for the greatest loss of good electrical dice, viz. surface particles and faults on, within, or under the silox passivation layer. Of course, if the die fails due to electrical shorting, it cannot be saved; but failures due to particulate may be saved by further cleaning. Some of the contamination results from the cleaning solvents, plastic fragments from the carrying trays and other handling steps. Particles can be oxidized and/or removed when excited by an RF field in oxygen plasmas, but this method of removal is unacceptable because there is risk of latent electrical damage due to surface charges. Foreign particles may also be removed by laser energy without visible damage to the protective coating (silox) or metallization beneath, but there is also risk of latent electrical damage due to surface charges. Particles are also removed by manual or mechanical means. However, many plastic bristles, pine splinters and bamboo splinters leave fragments on the surface. This method is not recommended because the dice or chips are small, fragile and difficult to handle. Additionally, the original particles are numerous and frequently are close to the wire bonding sites thereby increasing the risk of damage to the exposed metallization.

Since the trend is to increase the size of the dice, as component density requirements increase any particulate on the dice wafer could lead to failure at die visual inspection or affect the performance of the devices. Therefore, it is important to utilize processes and tooling which are not complex and where breakdown and down-time does not result in low efficiency. The methods and apparatus utilized for effective cleaning of dice or chips must be geared to easily cycle the dice repeatedly with inspection checks along the various steps involved thereby increasing the yield and lowering the cost of producing usable device die chips.

SUMMARY OF THE INVENTION

This invention relates to an improved process and apparatus for cleaning MOS-LSI dice which substantially increases the yield of usable MOS-LSI dice. The instant invention utilizes cleaning apparatus which includes a manifold fixture, multi-nozzle assembly and a process tank with pressurized gas and fluid support means.

Once the cleaning apparatus has been verified for operation and cleanliness, the die inserts are selected which will fit the size of the dice to be cleaned. The selected die inserts are pressed into the die cavities of the manifold fixture. Each die is transported by means of a vacuum probe and installed in the respective die insert. The installed dice are secured by the vacuum from the transport fixture. The loaded manifold fixture is positioned in the process tank and each die chip at this stage may be inspected, then sprayed with alcohol to dislodge and remove loose particles. This step is followed by a hand water rinse or scrubbing the dice with an alcohol saturated scrubbing tool. The next step is the attachment of a multi-nozzle assembly onto the manifold fixture where the dice are pressure rinsed with filtered, deionized water from the nozzle assembly followed by a pressurized filtered alcohol rinse utilizing an airbrush gun to dislodge loose particles. This step is followed by a filtered deionized water flush on the surface of the dice. Finally, the dice are dried with pressurized streams of filtered nitrogen, the multi-nozzle assembly is removed and the dice are again inspected, for example under a microscope. If the dice are found to be acceptable, that is substantially free of particles, they are removed and stored in clean teflon trays and sealed. The dice which still have particulate are again subjected to some or all of the steps previously discussed until they are found acceptable.

DETAILED DESCRIPTION OF THE PREFERRED EMBODIMENT

Figure 1:
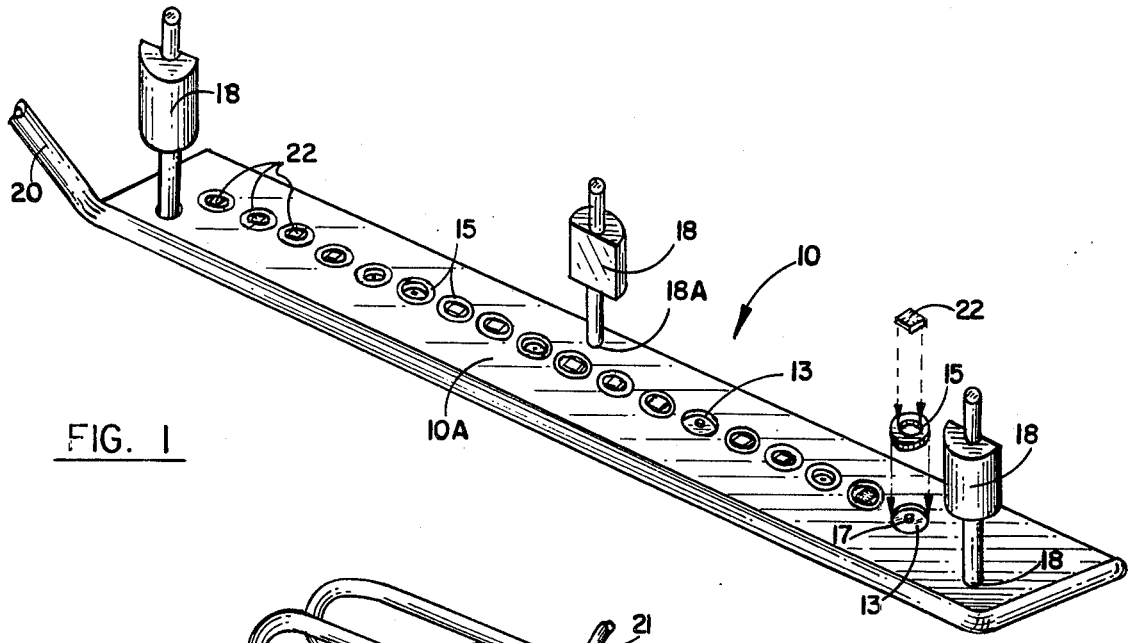
FIG. 1 illustrates the configuration of a manifold fixture which forms part of a preferred embodiment of this invention and the arrangement of dice and die inserts therein.

Referring to FIG. 1, there is illustrated manifold fixture 10 embodying principles of the present invention. Fixture 10 has a generally rectangular configuraton and may be constructed of any suitable material such as stainless steel. Fixture 10 has a flat surface 10A with a plurality of recessed cavities 13 designed to secure die cavity inserts 15. In a preferred embodiment, inserts 15 are annular rings which fit into cavities 13. The recessed cavities 13 include small apertures 17 in the bottom thereof, through fixture 10 and leading to vacuum line 20 to secure die insert 15 and dice 22. Fixture 10 may be of any configuration, e.g. circular or square, utilizing any desired number of cavities for handling any die size of common or mixed diagonal configuration. Fixture 10 also includes three metal dowels 18 for securing other apparatus to be discussed subsequently. Dowels 18 can be integrally formed with fixture 10 or, as in the preferred embodiment, inserted through apertures 18A.

Once the fixture 10 is verified to be clean, the valve (not shown) controlling the vacuum is closed and the fixture is ready for loading. Inserts 15, with cavities 13 that most closely approximate the die size to be cleaned are selected from storage. The selected inserts 15 are transported with teflon coated tweezers, or the like, to the flat surface of transport fixture 10 nearest the cavity 13 to be filled as shown in FIG. 1. Insert 15 is placed in the respective cavity 13 and lightly pressed into the cavity 13. To the extent necessary, all of the cavities 13 are filled with inserts 15 in this manner.

In this embodiment, for convenience, fixture 10 has twenty die cavities 13 handling dice having dimensions varying from 0.015 inch to 0.0300 inch.

The next step is the actual loading of the dice 22 on fixture 10. First, the vacuum controlling valve on fixture 10 is opened. Because the dice are small, fragile and difficult to handle, a teflon tipped vacuum probe, not shown, is used to pick up the dice 22. The dice are individually extracted from nearby storage trays and positioned in the respective die cavity insert 13. By releasing the vacuum on the probe, the vacuum from fixture 10 secures the respective die thereby minimizing the damage to the dice. One or more of the cavities are filled with dice in the same manner.

Figure 2:
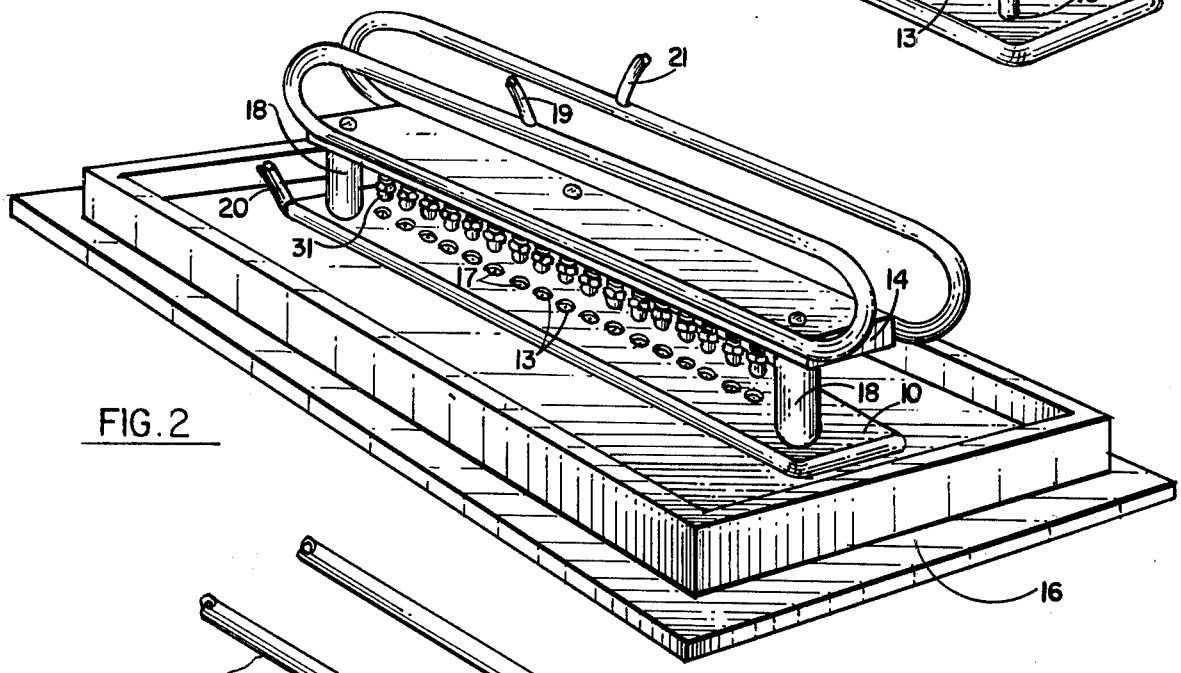
FIG. 2 is a perspective view of the overall arrangement and configuration of a preferred embodiment of this invention.

Referring to FIG. 2, there is shown process tank 16 which supports manifold fixture 10. Once manifold fixture 10 is loaded, as noted above, it is positioned relative to process tank 16 as illustrated in FIG. 2. Fixture 10 is secured to process tank 16 by positioning dowels 18. Process tank 16 includes a pressurized fluid system, not shown, for spraying deionized water, alcohol and dry nitrogen. The deionized water is of ultra-high purity, for example 16.0 to 18.0 meg. ohms-cm. The alcohol is preferably isopropyl, electronic high-purity grade and the nitrogen is gaseous electronic grade A. The pressurized system of tank 16 assures particulate-free fluids by utilizing final membrane filters of 0.45 micron for the incoming deionized water line and incoming dry nitrogen line. Final membrane filters of 0.45 micron are also utilized in the nitrogen lines on the final or existing deionized water lines, final dry nitrogen lines, and the final alcohol lines. FIG. 2 also illustrates multi-nozzle assembly 14 which secures to manifold fixture 10 via dowels 18 to be discussed subsequently.

The next step, after loaded fixture 10 is positioned on tank 16, consists of spraying the die chips with filtered alcohol utilizing a standard artists airbrush gun, which is held in a substantially vertical position over the die and passed over all die chips to dislodge and remove loose particles. This step is followed by a filtered deionized water flush over the dice from a teflon dispensing bottle. The various solutions, materials and the like are recovered in tank 16 and removed in a suitable manner which does not form a portion of the invention per se. At this point, fixture 10 can be removed from process tank 16, and, for example, placed under a microscope, to individually inspect each die chip and evaluate the extent of foreign particles.

The acceptability of a die with respect to particles and contamination, of course, may depend upon its use. Acceptable device die have no metallization faults, diffusion or oxide faults, no handling faults and no foreign material faults. For purpose of this invention, die which have material considered attached because it cannot be removed by nominal gas blow such as 20 psi are deemed not acceptable. At this stage, if there are acceptable chips, they may be removed from fixture 10.

Figure 3:
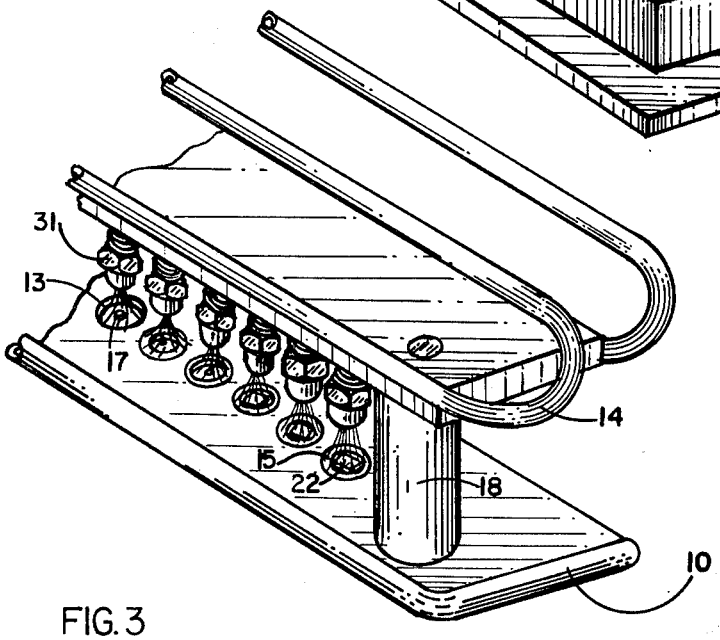
FIG. 3 is a side view illustrating details of a scrubbing tool.
Figure 4:
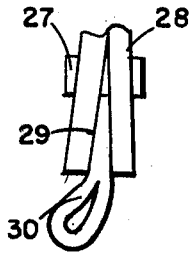
FIG. 4 is a partial perspective view of multi-nozzle assembly mounted upon vacuum transport fixture.

The remaining die chips are subjected to the next step which consists of scrubbing. Since the silox coating on the die is approximately 9000 angstroms, thick the scrubbing step must be conducted with care. Referring to FIG. 3, there is shown a teflon scrubbing tool 26 embodying principles of the present invention. Scrubbing tool 26 has a handle 28, clamp 27, and slot 29 for attaching scrub material 30, such as cellulose material. The cellulose material is approximately ¾ inch wide by 1 inch long. The scrub material is folded such that the ends are inserted in the slot 29 and clamp 27 secures the folded portion. The folded portion 30 extends approximately ½ inch from the end of the tool handle. Hence, the folded portion 30, in mop-like fashion, does the actual scrubbing on the die chip surface. Cellulose material is used as the scrubbing material because of its texture. It is less likely to add particulate or to damage the die chip surface by abrasions or dislodge it from the inserts. The scrubbing tool is saturated in alcohol then held in a substantially vertical position over the die chips. It is stroked gently in one direction only over all the die chips 22 in a sweeping, continuous motion one or several times. Preferably, the scrubbing material 30 is saturated with a cleaning material, such as alcohol, to reduce friction on dice 22. In addition, the dice are stroked in only one direction to minimize the dislodging thereof.

The next step requires that multi-nozzle assembly 14 be mounted to fixture 10. The nozzle assembly is fitted to manifold fixture by engaging the dowels 18 as shown in FIG. 3. Multi-nozzle assembly 14 includes a plurality of nozzles 31 positioned to spray over each insert 15 and the associated die chip. Multi-nozzle assembly 14 has separate lines 19 and 21 that are connected to the pressurized fluid system of process tank 16. Thus, the process, as previously described, is repeated and the spraying by mutli-nozzle assembly 14 is controlled by the valves on process tank 16. The dice are then rinsed with deionized water which is pressure sprayed from the nozzles 31 for approximately 1 minute.

Referring to FIG. 3, there is shown a partial, perspective view that better illustrates multi-nozzle assembly 14 with nozzles 31 spraying directly on die 22 which are secured in inserts 15, which are secured in cavities 13 of manifold fixture 10. After the water rinse, an alcohol pressurized rinse follows and finally the die chips are dried off with pressurized dry nitrogen, as noted above. After all parts are dry, process tank valves are secured, nozzle system 14 is removed and fixture 10 is removed from process tank 16. The dice are individually inspected, for example, with a microscope. The die chips that are acceptable are removed from fixture 10 and stored in clean teflon trays with clean sealing covers.

The remaining die are recycled through the complete cleaning process or whichever steps of the invention are required to rid them of particulate.

Thus, there is shown and described a preferred process and apparatus for handling individually and/or collectively device dice of common or mixed diagonal dimensions ranging from 0.015 inch to 0.300 inch. To clean and dry one or more of the same or mixed sizes at one time by utilizing pressurized fluids and/or gas propelled solutions, directed through mixing and fluid agitation nozzles. The result is that the instant invention increases the yield of usable MOS-LSI dice and, hence, results in lowering the cost of producing the device die chips. This invention is not dependent upon specific components and can be achieved with interchangeable steps or components without departing from the instant invention.

This description is intended to be illustrative only and not limitative. The scope of this invention is intended to be limited only by the claims appended hereto.

Having thus discussed a preferred embodiment of this invention, what is claimed is:

1. A process for cleaning the surface of MOS-LSI die, said process comprising the steps of:

installing said die in a manifold fixture;

spraying alcohol over the die surfaces, flushing the surfaces of said die with deionized water;

scrubbing the surfaces of said die;

mounting a nozzle assembly adjacent said manifold fixture;

directing pressurized jets of deionized water and pressurized jets of alcohol on said die surfaces from said nozzle assembly; and drying said die surfaces with streams of dry gas.

2. The process recited in claim 1 wherein said die is installed in said manifold fixture after selecting an insert whose cavity size closely fits the die to be cleaned and transporting and pressing said insert into a cavity of said manifold fixture.

3. A process as recited in claim 1 whereby said die is transported with a teflon probe having vacuum means for holding said die.

4. The process recited in claim 1 wherein said die surfaces are inspected after said drying step and said die is recycled through the prior steps if the surfaces are not clean.

5. A process as recited in claim 1 wherein said scrubbing step is conducted in a mop-like fashion with a tool having a handle and cellulose material attached to the one end.

6. A process as recited in claim 5 whereby said scrubbing step is accomplished with said scrubbing tool material when saturated in alcohol, and said tool is stroked in only one direction over the surface of said die.

7. Apparatus for cleaning MOS-LSI die chips comprising:

manifold fixture means for securing a plurality of die chips;

said manifold fixture means including a plurality of cavities therein for securing cavity inserts of variable sizes and having small apertures that align with similar apertures in said cavities leading to a vacuum source for securing said die chips in said cavity inserts;

multi-nozzle assembly means associated with said manifold fixture for directing pressurized fluid onto said die chips; and cleaning tank means for supporting said manifold fixture and said multi-nozzle assembly.

8. The apparatus recited in claim 7 wherein said cleaning tank means includes means for supplying and controlling said pressured fluid directed through said multi-nozzle assembly and means for collecting fluid from said multi-nozzle assembly means.

9. An apparatus as recited in claim 8 wherein said cleaning tank means includes filters on the incoming and exiting lines of said multi-nozzle assembly.

10. The apparatus recited in claim 7 wherein said cavity inserts each comprise an annular ring which fits into a respective cavity in said manifold mixture means, said cavity inserts each including an aperture therein for holding a die chip therein.

11. The apparatus recited in claim 7 including mounting means for mounting said manifold fixture means, said multi-nozzle assembly means, and said cleaning tank means in proper position and alignment.

12. The apparatus recited in claim 7 including means associated with said multi-nozzle assembly for supplying said pressurized fluid thereto.

* * * * *